US005863644A

United States Patent [19]

Bönigk et al.

[11] Patent Number: 5,863,644

[45] Date of Patent: Jan. 26, 1999

[54] WOVEN AND LAID HYBRID YARN STRUCTURES OF ADJUSTABLE GAS AND/OR LIQUID TIGHTNESS, FURTHER PROCESSING THEREOF, TEXTILE SHEET MATERIALS OF PREDETERMINED GAS AND/OR PERMEABILITY, AND USE THEREOF

[75] Inventors: Burkhard Bönigk, Königsbrunn; Hans-Joachim Brüning, Augsburg, both of Germany

[73] Assignee: Hoechst Trevira GmbH & Co KG, Germany

[21] Appl. No.: 728,755

[22] Filed: Oct. 11, 1996

[30] Foreign Application Priority Data

Oct. 11, 1995 [DE] Germany ..... 195 37 702.8

[51] Int. Cl.[6] ..... B32B 7/02

[52] U.S. Cl. ..... 428/221; 428/257; 428/364; 428/374; 428/395; 428/902; 139/383 A; 139/420 A; 528/185; 528/190; 528/191

[58] Field of Search ..... 428/257, 364, 428/374, 395, 902, 221; 139/420 A, 383 A; 528/185, 190, 191

[56] References Cited

U.S. PATENT DOCUMENTS 5,458,693 10/1995 Codorniu ..... 139/383 A 5,736,471 4/1998 Thielemann et al. ..... 442/220

FOREIGN PATENT DOCUMENTS 0 542 070 5/1993 European Pat. Off. .
0 630 735 12/1994 European Pat. Off. .
41 42 884 7/1992 Germany .
42 43 465 7/1993 Germany .

OTHER PUBLICATIONS

Database WPI Section Ch, Week 8839 Derwent Publications Ltd., London, AN 88–276317.

Patent Abstracts of Japan, vol. 16, No. 425 (C–0982) 7 Sep. 1992 JP–A–04 146235 (Wada Osamu) 20 May 1992.

Patent Abstracts of Japan, vol. 16, No. 82 (M–1215), 27 Feb. 1991 & JP–A–03 266745 (Bando), 27 Nov. 1991.

*Primary Examiner*—Jeffrey Stucker
*Attorney, Agent, or Firm*—Connolly & Hutz

[57] ABSTRACT

Woven or laid structures comprising at least two systems of parallel threads, at least one of these thread systems having more than 10 threads per centimeter and comprising at least 10%, based on the thread system, of hybrid yarns comprising reinforcing filaments and lower melting matrix filaments composed of thermoplastic polymers. In such woven or laid structures, the matrix component can be melted to form textile sheet materials of adjustable gas and/or liquid permeability, which are especially useful for manufacturing airbags.

31 Claims, No Drawings

WOVEN AND LAID HYBRID YARN STRUCTURES OF ADJUSTABLE GAS AND/OR LIQUID TIGHTNESS, FURTHER PROCESSING THEREOF, TEXTILE SHEET MATERIALS OF PREDETERMINED GAS AND/OR PERMEABILITY, AND USE THEREOF

The present invention relates to woven and laid structures of adjustable gas and/or liquid permeability, from which textile sheet materials of predetermined gas and/or liquid permeability are simple to manufacture. These textile sheet materials can be used in many applications, especially for manufacturing airbags.

Woven and laid structures of this kind are used inter alia for manufacturing airbags which inflate explosively in the event of an accident to protect the occupants of the automobile, especially the driver, from impact injuries. Airbags are partly manufactured from gas-impermeable coated woven fabrics which include gas-permeable filter fabric or filter fabric segment or an opening on one side of the bag.

There have been proposals to use uncoated fabrics for manufacturing airbags, for example in EP-A-453,678. According to the description in this reference, the production of such fabrics involves an at least twofold calendering of the loomstate fabric to achieve the desired gas tightness. The omission of the coating is thus bought at the cost of additional processing steps.

It has also been proposed that fabrics for use in airbags be produced from yarns or membranes comprising meltable components.

For instance, DE-A-4,009,611 describes a gas-permeable fabric woven from a synthetic yarn spun from a staple fiber blend which, as well as aramid fibers, includes thermoformable fibers, such as fibers composed of polyamides, polyvinyl chloride, propylene or polyester. The description says it is important that the yarns forming the fabric are not filament yarns but staple fiber yarns in order that protruding fiber ends may be available over the entire length of the yarn to render the yarn particularly bulky and thereby enhance the filtering performance of the resulting fabric.

DE-A-4,411,159 discloses an airbag manufactured from a woven fabric which comprises warp and weft threads each made of a polymer material having a high melting point and which additionally includes woven-in polymeric threads having a low melting point, as of polyamide or polyester. In the woven structure, the low melting point polymeric threads are arranged at predetermined distances and extend along at least one of the warp and weft threads. Heating these polymeric threads will weld the warp and weft threads together. This is intended to prevent the fabric fraying in press or stamper cutting. This woven fabric can also be produced using hybrid yarns. As well as these yarns, however, these fabrics always include yarns composed of a polymeric material having a high melting point, and these latter yarns account for the main part of the fabric.

JP-A-03-266,745 describes a flexible tape composed of hybrid yarns which, in addition to a first filament yarn component, include a matrix-forming elastomeric second filament yarn component. Such tapes are wound on a mandrel, and melting the second filament yarn component will result in the formation of a flexible shape suitable for use as an airbag. This manufacturing route obviates the production of a textile fabric, as a woven or knitted fabric.

GB-A-2,251,410 describes the manufacture of airbags involving the formation of seams using a meltable fiber.

JP-A-05-338,510 discloses a woven fabric for manufacturing airbags wherein one fabric side comprises short meltable fibers.

Finally, DE-A-4,142,884 discloses an airbag manufactured from fabrics constructed from bicomponent fibers of the core-sheath type or of the side-by-side type. The first component used in the bicomponent fibers is polyamide, polyester, aramid or ultrahigh molecular weight polyethylene, while the second component used is a low melting polymer, such as polyethylene, modified polyester, polyurethane or ethylene-vinyl acetate copolymer. According to the description, the difference between the melting points of the materials forming the two components shall be at least 100° C. A further embodiment comprises an airbag composed of an elastic membrane having a breaking extension of at least 100%. A third embodiment comprises an airbag composed of an elastomeric body and a shaping part attached to parts of this body, the shaping part comprising elastic fibers or yarns and high modulus filaments. This embodiment, as well as the actual airbag, thus additionally requires an accessory to keep the inflated airbag in a suitable shape.

Prior artisans have further disclosed textile sheet materials which comprise loadbearing fibers and which have been provided with a coating which makes it possible to fold the textile sheet material to fit it into a small space and/or provides a long flex life. These include for example PVC-coated awnings or PVC-coated weatherwear. However, these products are manufactured by the subsequent coating of a textile sheet material; this involves the use of coating compositions whose constituents belong to different chemical classes than the constituents of the textile sheet material.

JP-A-04-146,235 discloses wovens and knits comprising a hybrid yarn composed of a multicomponent fiber and a conventional polyester fiber. The multicomponent fiber consists of a thermoplastic elastomer, as of an elastomeric polyurethane or an elastomeric polyester, and of a polyester.

The fabrics described are intended for textile applications and exhibit good elastic recovery and crease resistance. The fabrics are stabilized by the elastomeric component melting during dyeing and becoming thoroughly dispersed within the fabric. There is nothing in this reference suggesting the production of gastight fabrics.

JP-A-04-353,525 discloses prepregs composed of hybrid yarns constructed from reinforcing fibers and filaments of thermoplastic and elastomeric materials. The thermoplastic and elastomeric components mentioned include polyesters and polyurethanes. The prepregs are used for producing composites; for this purpose, the two filament types can be used to produce hybrid yarns which are made into woven fabrics and then by heating converted into shaped structures, or direct shaping processes are used, such as pultrusion or filament winding. The prepregs can be used to produce shaped structures having complicated shapes. The shaped structures are notable for good damping properties, high flexibility and impact toughness and can be used as conveyor belts, shoe soles or sports goods. There is nothing in this reference to suggest the production of textile sheet materials of predetermined gas permeability.

Furthermore, our prior German Patent Application 19531001.2 discloses laid hybrid yarn structures useful as loadbearing components for nonwoven reinforcement. The thread counts of the laid structures specifically described therein are relatively high at up to 10 threads per centimeter.

There continues to be a need for textile sheet materials comprising reinforcing filaments and matrix material, whose gas and/or liquid permeability can be specifically adjusted and which have a long flex life (even at temperatures down to about −25° C.) and also high adhesion between reinforcing filaments and matrix material, especially for precursors which are simple to make into such textile sheet materials.

It has now been surprisingly found that woven or laid structures derived from specific hybrid yarns are simple to process into textile sheet materials of specifically adjustable gas and/or liquid permeability. Compared with conventionally coated sheet materials, these textile sheet materials permit the manufacture of products folded into a small space which are instantaneously inflatable and highly useful for manufacturing airbags.

The present invention accordingly provides a woven or laid structure comprising at least two systems of parallel threads, at least one of these thread systems having more than 10 threads per centimeter and comprising at least 10%, based on the thread system, of hybrid yarns comprising reinforcing filaments and lower melting matrix filaments composed of thermoplastic polymers.

The woven or laid structures of this invention may comprise a small proportion of or consist entirely of the above-defined hybrid yarns depending on the application in question. For instance, only one of the thread systems making up the woven or laid structure of this invention may be constructed wholly or else only partly of hybrid yarns. The proportion of hybrid yarn to be selected in a specific case is determined not only by the application desired but also by the particular proportion of matrix filament in the hybrid yarn. The proportion of hybrid yarn in the woven or laid structure, or the proportion of matrix filament in the hybrid yarn, is chosen according to the further processing requirements.

As well as the above-defined hybrid yarns, a proportion of the yarns making up the woven or laid structure may consist only of loadbearing filaments or only of bonding filaments. The proportion of hybrid yarn is in either case to be chosen so that its proportion in at least one of the thread systems making up the woven or laid structure is at least 10%, preferably at least 50%, very particularly preferably at least 95%.

Preferably, at least one direction, for example the weft direction or the warp direction, of the woven or laid structure of this invention is made up completely of the above-defined hybrid yarns.

The woven or laid structures of this invention can consist of two or more thread systems depending on the intended application; preference is given to two thread systems (a warp thread system and a weft thread system).

The thread counts of at least one of the thread systems of the woven or laid structures of this invention amount to at least 10 threads per centimeter, preferably to at least 15 threads per centimeter and particularly preferably to at least 20 threads per centimeter.

Preference is given to a woven or laid structure comprising two thread systems having thread counts of at least 15 threads per centimeter and at least 10%, preferably at least 50%, of hybrid yarns comprising reinforcing filaments and lower melting matrix filaments composed of thermoplastic polymers Very particular preference is given to a woven or laid structure consisting of two thread systems each comprising at least 95% of hybrid yarns comprising reinforcing filaments and lower melting matrix filaments composed of thermoplastic polymers In a further very particularly preferred embodiment of the woven or laid structure of this invention, at least one thread system comprises a combination of hybrid yarns comprising reinforcing filaments and lower melting matrix filaments and of yarns composed of loadbearing filaments, or at least one thread system comprises a combination of different hybrid yarns comprising reinforcing filaments and different proportions of lower melting matrix filaments, in each case a plurality of the hybrid yarns and of the yarns composed of loadbearing filaments or a plurality of the different hybrid yarns being arranged in a predetermined pattern.

This embodiment makes it possible to adjust the gas and/or liquid permeability of parts of the textile sheet emerging from the further processing in a controlled manner.

In the hybrid yarns used for producing the woven or laid structure of this invention, the matrix filaments composed of thermoplastic polymers have a melting point which is usually at least 30° C. below the melting point or the decomposition point of the reinforcing filaments.

The production of the woven or laid structures of this invention can be effected by means of conventional techniques. Examples thereof may be found in EP-A-442,373, -509,399 and -665,313.

The reinforcing or loadbearing filaments used can be filaments composed of a multiplicity of materials. Reinforcing or loadbearing filaments for the purposes of this invention are filaments performing a reinforcing function in the textile sheet materials to be produced from the woven or laid structures.

In a first preferred embodiment, the reinforcing or loadbearing filaments are constructed of individual filaments having an initial modulus of more than 50 Gpa.

Preferred reinforcing or loadbearing filaments of this type consist of glass; carbon; metals or metal alloys, such as steel, aluminum or tungsten; nonmetals, such as boron; metal, semimetal or nonmetal carboxides, carbides or nitrides, such as aluminum oxide, zirconium oxide, boron nitride, boron carbide, silicon carbide, silicon dioxide (quartz); ceramic; or high performance polymers (i.e. fibers with minimal if any stretch, a very high initial modulus and a very high breaking strength), such as liquid-crystalline polyesters (LCP), poly (bisbenzimidazobenzophenanthroline)s (BBB), poly(amide-imide)s (PAI), polybenzimidazoles (PBI), poly(p-phenylenebenzobisoxazole)s (PBO), poly(p-phenylenebenzobisthiazole)s (PBT), polyether ketones (PEK, PEEK, PEEKK), polyetherimides (PEI), polyethersulfones (PESU), polyimides (PI), poly(p-phenylene)s (PPP), polyarylene sulfides (PPS), polysulfones (PSU), polyolefins, such as polyethylene (PE) or polypropylene (PP), and aramids (HMA), such as poly(m-phenyleneisophthalamide), poly(m-phenyleneterephthalamide), poly(p-phenyleneisophthalamide), poly(p-phenyleneterephthalamide), or aramids which are spinnable from organic solvents, such as N-methylpyrrolidone, and are derived from terephthaloyl dichloride and a mixture of two or more aromatic diamines, for example the combination of p-phenylenediamine, 1,4-bis(4-aminophenoxy)benzene and 3,3'-dimethylbenzidine, or the combination of p-phenylenediamine, 1,4-bis-(4-aminophenoxy)benzene and 3,4'-diaminodiphenyl ether, or the combination of p-phenylenediamine, m-phenylenediamine and 1,4-bis(4-aminophenoxy)benzene.

Particular preference is given to reinforcing or loadbearing filaments composed of glass, carbon or aromatic polyamide.

In a second particularly preferred embodiment, the reinforcing or loadbearing filaments and matrix or bonding filaments used consist of polymeric materials of the same class of polymer, for example of polyolefins, of polyamides or preferably of polyesters, especially of polyethylene terephthalate.

In this embodiment, the individual filaments of the reinforcing or loadbearing filaments have an initial modulus of more than 10 Gpa. Reinforcing or loadbearing filaments for this embodiment are preferably high strength, low shrinkage polyester filament yarns, especially having a yarn linear density of not more than 750 dtex, a tenacity of not less than 55 cN/tex, and ultimate extension of not less than 15% and a hot air shrinkage (measured at 200° C.) of not more than 9%.

The ultimate tensile strength and the ultimate extension of the polyester yarns used are measured on the line of DIN 53 830 Part 1.

The hot air shrinkage of the polyester yarns used is measured on the line of DIN 53 866 Part 3 at 200° C. on freely suspended yarn samples using a treatment time of 15 minutes. A 10 m hank is used wound with a reel tension of 0.5 cN/tex.

Matrix or bonding filaments in the hybrid yarns used in this invention consist of or comprise thermoplastic polymers. These can be any desired melt-spinnable thermoplastics, as long as the filaments produced therefrom melt at a lower temperature than the melting or decomposition temperature of the respective reinforcing filaments.

Preference is given to using matrix or bonding filaments composed of a thermoplastic modified polyester, especially a modified polyethylene terephthalate; the modification brings about a lowering in the melting point compared with the filament composed of unmodified polyester.

Particularly preferred modified polyesters of this type contain structural repeat units of the formulae I and II

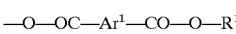

$$—O—OC—Ar^1—CO—O—R^1— \quad (I),$$

and $$—O—OC—R^2—CO—O—R^3— \quad (II),$$

where $Ar^1$ is a bivalent mono- or polycyclic aromatic radical whose free valances are disposed para or comparably parallel or coaxial to each other, preferably 1,4-phenylene and/or 2,6-naphthylene, $R^1$ and $R^3$ are independently of each other bivalent aliphatic or cycloaliphatic radicals, especially radicals of the formula $—C_nH_{2n}—$, where n is an integer between 2 and 6, especially ethylene, or a radical derived from cyclohexanedimethanol, and $R^2$ is a bivalent aliphatic, cycloaliphatic or mono- or polycyclic aromatic radical whose free valences are disposed meta or comparably angled to each other, preferably 1,3-phenylene.

Very particularly preferred modified polyesters of this type contain 40 to 95 mol % of structural repeat units of the formula I and 60 to 5 mol % of structural repeat units of the formula II where $Ar^1$ is 1,4-phenylene and/or 2,6-naphthylene, $R^1$ and $R^3$ are each ethylene and $R^2$ is 1,3-phenylene.

In a further preferred embodiment, the matrix or bonding filaments used consist of or comprise a thermoplastic and elastomeric polymer. This can again be any desired melt-spinnable and elastomeric thermoplastic, as long as the filaments produced therefrom melt at a lower temperature than the melting or decomposition temperature of the respective reinforcing filaments.

An "elastomeric polymer" for the purposes of this invention is a polymer whose glass transition temperature is lower than 23° C., preferably lower than 0° C.

Examples of thermoplastic and elastomeric polymers are elastomeric polyamides, polyolefins, polyesters and polyurethanes.

Particular preference is given to using hybrid yarns comprising matrix fibers composed of a thermoplastic and elastomeric polyester containing structural repeat units of the formulae III and IV

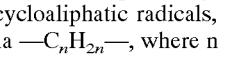

$$—O—OC—Ar^2—CO—O—R^4— \quad (III),$$

and

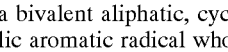

$$—O—OC—Ar^3—CO—O—R^5— \quad (IV),$$

where $Ar^2$ and $Ar^3$ are independently of each other bivalent aromatic radicals, $R^4$ is a bivalent aliphatic or cycloaliphatic radical, and $R^5$ is the bivalent radical of polyalkylene ether.

Preferably $Ar^2$ and $Ar^3$ are independently of each other a phenylene and/or a naphthylene radical.

Particularly preferably $Ar^2$ and $Ar^3$ are both 1,4-phenylene.

Bivalent aliphatic $R^4$ is straight-chain or branched alkylene or alkylidene; the radicals in question customarily have two to twenty carbon atoms, preferably two to eight carbon atoms and in particular two to four carbon atoms.

$R^4$ is particularly preferably straight-chain alkylene having two to six carbon atoms, in particular ethylene.

Bivalent cycloaliphatic $R^4$ customarily means a radical containing five to eight, preferably six, ring carbon atoms; this carbocycle is particularly preferably part of an aliphatic chain. An example of a particularly preferred representative of this type is the radical of cyclohexanedimethanol.

$R^4$ is particularly preferably a radical of the formula $—C_nH_{2n}—$, where n is an integer between 2 and 6, or a radical derived from cyclohexanedimethanol.

$R^5$, a bivalent radical of a polyoxyalkylene, is customarily a polyether radical containing recurring oxyethylene, oxypropylene or especially oxybutylene units or mixtures thereof.

$R^5$ is particularly preferably a radical of the formula V

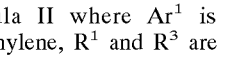

$$—[C_oH_{2o}—O]_z—C_oH_{2o}— \quad (V),$$

where o is an integer from two to four and z is an integer from 1 to 50.

Very particularly preferably, o is four and z is an integer from 10 to 18.

Particular preference is given to using hybrid yarns composed of thermoplastic elastomeric polyester containing the above-defined structural repeat units of the formulae III and IV where $Ar^2$ and $Ar^3$ are each 1,4phenylene, $R^4$ is ethylene, $R^5$ is a group of the above-defined formula V, o is four and wherein the proportion of structural repeat units of the formula V is 5 to 60% by weight, based on the proportion of the polyester molecule.

Fibers composed of such polyesters have different melting points depending on the proportion of structural repeat units of the formula V; the higher the proportion of these structural units, the lower it is possible to set the melting point. For instance, fibers composed of an elastomeric polymer of this type containing 13% by weight of polyoxybutylene have a melting point of about 220° C., whereas fibers composed of an elastomeric polyester of this type which contains 53% by weight of polyoxybutylene have a melting point of about 160° C.

Particular preference is given to using hybrid yarns comprising matrix fibers composed of thermoplastic elastomeric polyurethane containing structural repeat units of the formulae VI and VII $$—[O—OC—NH—R^6—NH—CO—O—R^7]— \quad (VI),$$

$$—[O—OC—NH—R^8—NH—CO—O—R^9]— \quad (VII),$$

where $R^6$, $R^7$ and $R^8$ are each independently of the others a bivalent aliphatic, cycloaliphatic, aromatic or araliphatic radical, $R^6$ and $R^8$ are preferably bivalent mono- or bicyclic aromatic radicals, especially phenylene and/or naphthylene, $R^7$ is preferably a radical of the formula $—C_pH_{2p}—$, where p is an integer between 2 and 6, or a radical derived from cyclohexanedimethanol, especially 1,4-butanediyl, $R^9$ is a radical of the formulae VIII and/or IX $$—[C_qH_{2q}—O]_x—C_qH_{2q}— \quad (VIII),$$

$$—[R^{10}—O—OC—R^{11}—CO—O]_y—R^{10}— \quad (IX),$$

where q is an integer from two to four and x is an integer from 1 to 50, $R^{10}$ is a bivalent aliphatic or cycloaliphatic radical or a radical of the formula VIII, $R^{11}$ is a bivalent aliphatic, cycloaliphatic, aromatic or araliphatic radical, and y is an integer from 1 to 50.

Particular preference is given to using hybrid yarns composed of thermoplastic and elastomeric polyurethane containing the above-defined structural repeat units of the formulae VI and VII wherein $R^7$ is 1,4-butanediyl, $R^9$ is a radical of the above-defined formula VIII, where q is an integer from two to four, especially four, and x is an integer from 1 to 50, preferably from 10 to 18, and $R^6$ and $R^8$ are independently of each other phenylene or naphthylene.

Preferred elastomeric polyamides are known per se and are described for example in Domininghaus: "Die Kunststoffe und ihre Eigenschaften", 3rd edition, VDI Verlag GmbH, Düsseldorf 1988, pages 465–461.

Any bivalent aliphatic radicals in the above-defined structural formulae represent branched and especially straight-chain alkylene, for example alkylene having two to twenty, preferably two to eight, carbon atoms. Examples of such radicals are 1,2-ethanediyl, 1,3-propanediyl, 1,4-butanediyl, 1,5-pentanediyl, 1,6-hexanediyl or 1,8-octanediyl.

Any bivalent cycloaliphatic radicals in the above-defined structural formulae are groups containing carbocyclic radicals having five to eight, preferably six, ring carbon atoms. Examples of such radicals are 1,4-cyclohexanediyl or the group $—CH_2—C_6H_{10}—CH_2—$.

Any bivalent aromatic radicals in the above-defined structural formulae are mono- or polycyclic aromatic hydrocarbon radicals or heterocyclic aromatic radicals, which can be mono- or polycyclic. Heterocyclic aromatic radicals have in particular one or two oxygen, nitrogen or sulfur atoms in the aromatic nucleus.

Polycyclic aromatic radicals can be fused together or joined together via C—C-bonds or via bridging groups, such as —O—, —S—, —CO— or —CO—NH— groups.

The valence bonds of the bivalent aromatic radicals can be disposed para or comparably coaxial or parallel to each other or else meta or comparably angled.

Valence bonds in coaxial or parallel disposition point in opposite directions. An example of oppositely directed coaxial bonds are the biphenyl-4,4'-diyl bonds. An example of oppositely directed parallel bonds are the naphthalene-1,5 or -2,6 bonds, whereas the naphthalene-1,8 bonds are parallel but point in the same direction.

Examples of preferred bivalent aromatic radicals whose valence bonds are disposed para or comparably coaxial or parallel are monocyclic aromatic radicals having para-disposed free valences, especially 1,4-phenylene, or bicyclic fused aromatic radicals having oppositely directed parallel bonds, especially 1,4-, 1,5- and 2,6-naphthylene, or bicyclic C—C-linked aromatic radicals having oppositely directed coaxial bonds, especially 4,4'-biphenylylene.

Examples of preferred bivalent aromatic radicals whose valence bonds are disposed meta or comparably angled relative to each other are monocyclic aromatic radicals having meta-disposed free valences, especially 1,3-phenylene, or bicyclic fused aromatic radicals having angled bonds, especially 1,6- and 2,7-naphthylene, or bicyclic C—C-linked aromatic radicals having angled bonds, especially 3,4'-biphenylylene.

Any bivalent araliphatic radicals are groups containing one or more bivalent aromatic radicals combined via one or two valences with an alkylene radical. A preferred example of such a radical is $—C_6H_4—CH_2—$.

The structural repeat units of the formula III or VI on the one hand and IV or VII on the other are typical hard and soft segments, respectively. Thermoplastic polyesters or polyurethanes of this type are known and are described for example in Domininghaus: "Die Kunststoffe und ihre Eigenschaften", 3rd edition, VDI Verlag GmbH, D üsseldorf 1988, pages 518–524.

$R^6$ and $R^8$ are preferably bivalent mono- or bicyclic aromatic radicals, especially phenylene and/or naphthylene.

$R^7$ is preferably a radical of the formula $—C_pH_{2p}—$, where p is an integer between 2 and 6, or a radical derived from cyclohexanedimethanol. $R^7$ is particularly preferably 1,4-butanediyl.

$R^9$ is preferably a radical of the above-defined formula VIII.

$R^9$ is particularly preferably a radical of the formula VIII where q is an integer from two to four, especially four, and x is an integer from 1 to 50, preferably from 10 to 18.

Similarly preferably $R^9$ is a radical of the above-defined formula IX where $R^{10}$ is a radical of the formula VIII, and $R^7$ is a radical of the formula—$C_pH_{2p}$—where p is an integer between 2 and 6, especially 1,4-butanediyl, or a radical derived from cyclohexanedimethanol, or a phenylene and/or naphthylene radical.

Very particular preference is given to using thermoplastic elastomeric polyurethanes containing the above-defined structural repeat units of the formulae VI and VII wherein $R^7$ is 1,4-butanediyl, $R^9$ is a radical of the above-defined formula VIII, where q is an integer from two to four, especially four, and x is an integer from 1 to 50, preferably from 10 to 18, and $R^6$ and $R^8$ are independently of each other phenylene or naphthylene.

Fibers composed of such polyurethanes have different melting points depending on the proportion of structural repeat units of the formula VIII or IX; the higher the proportion of these structural units, the lower it is possible to set the melting point.

All these aliphatic, cycloaliphatic, aromatic, araliphatic or polyoxyalkylene radicals can be substituted by inert groups. These are to be understood as meaning substituent having no adverse effect on the intended application.

Examples of such substituents are alkyl, alkoxy or halogen.

Alkyl is branched and especially straight-chain alkyl, for example alkyl having one to six carbon atoms, especially methyl.

Alkoxy is branched and especially straight-chain alkoxy, for example alkoxy having one to six carbon atoms, especially methoxy.

Halogen is for example fluorine, bromine or especially chlorine.

The matrix filaments used in the hybrid yarn used in this invention can be composed of thermoplastic polymers which customarily have an intrinsic viscosity of at least 0.5 dl/g, preferably 0.6 to 1.5 dl/g. The intrinsic viscosity is measured in a solution of the thermoplastic polymer in dichloroacetic acid at 25° C.

If the hybrid yarn to be used in this invention comprises reinforcing filaments composed of polyesters, these polyesters customarily have an intrinsic viscosity of at least 0.5 dl/g, preferably 0.6 to 1.5 dl/g. The intrinsic viscosity is measured as described above.

The hybrid yarns used in this invention customarily have yarn linear densities from 2000 to 150 dtex, preferably from 1100 to 150 dtex.

The linear densities of the reinforcing or loadbearing filaments and of the matrix or bonding filaments customarily vary within the range from 2 to 10 dtex, preferably from 4 to 8 dtex.

The reinforcing or loadbearing filaments and the matrix or bonding filaments can have any desired cross sections, for example ellipsoidal, bi-or multilobal, ribbony or preferably round.

The production of the thermoplastic polymers is effected according to conventional processes by polycondensation of the corresponding bifunctional monomer components. In the case of polyesters these are customarily dicarboxylic acids or esters and the corresponding diol components. Such thermoplastic and possibly elastomeric polyesters, polyurethanes, polyamides and polyolefins are already known.

The reinforcing or loadbearing filaments used in the textile sheet materials of this invention are likewise known per se.

The mechanical properties of the hybrid yarns used in this invention can be varied as a function of the composition, such as type and proportion of reinforcing filaments or matrix filaments, and as a function of the physical construction of the yarns, for example degree of intermingling, within wide limits. The matrix filament proportion is customarily from 3 to 50% by weight, based on the weight of the hybrid yarn.

The term "hybrid yarn" in this description is to be understood in its widest sense. It is accordingly to be understood as meaning any combination comprising reinforcing filaments and the above-defined matrix filaments.

Examples of possible hybrid yarn types are filament yarns composed of different types of filaments which are interlaced or combined by means of some other technology, for example twisting. All these hybrid yarns are characterized by the presence of two or more types of filaments, at least one filament type being a reinforcing filament and at least one filament type being a matrix filament within the meaning of the definitions given above.

Particular preference is given to using hybrid yarns produced by intermingling or commingling techniques.

The production of the hybrid yarns used in this invention will now be described by way of example with reference to the preferred jet-interlaced yarns. Other types of hybrid yarns can be produced in a conventional manner.

The interlacing of the hybrid yarns composed of reinforcing and matrix filaments of the above-described first embodiment is preferably effected by means of a specific high temperature interlacing process described in EP-B-0, 455,193. Here, to avoid filament breakages during interlacing, the filaments are heated to close to the softening point (about 600° C. in the case of glass) before interlacing. The heating can be effected by godets and/or heating tube, while the low melting thermoplastic individual filaments composed of polyester are fed into the superordinate interlacing jet without preheating. These flat, highly coherent hybrid yarns can be woven up without problems.

The production of the hybrid yarns composed of reinforcing and matrix filaments of the above-described second embodiment can be effected according to conventional interlacing techniques, for example by intermingling or commingling techniques, as described for example in Chemiefasern/Textilindustrie, (7/8)1989, T 185–7.

Such yarns can consist of reinforcing and matrix filaments composed of different or preferably identical chemical classes.

The woven or laid structures of this invention can be processed in a simple manner by application of elevated temperatures, with or without employment of superatmospheric or subatmospheric pressure, for example by calendering, to form textile sheet materials of predetermined gas and/or liquid permeability.

The present invention also provides a process for producing textile sheet materials of predetermined gas and/or liquid permeability, which comprises a) providing a woven or laid structure comprising hybrid yarns as defined above, and b) subjecting this woven or laid structure to a thermal treatment under such conditions that the matrix filaments melt to form a textile sheet material of predetermined gas and/or liquid permeability.

The thermal treatment of step b) can be effected for example by contact heating, by irradiation, by convection (hot air fans), by ultrasonication or by a combination of these measures.

Particular preference is given to such a process wherein the woven or laid structures provided in step a) comprise hybrid yarns, or combinations of reinforcing and hybrid yarns as defined further above, arranged in a predetermined pattern.

"Textile sheet materials of predetermined gas and/or liquid permeability" for the purposes of this invention are textile sheet materials derived from the above-defined woven or laid structures by melting of the matrix component. The property profile of such textile sheet materials can be adjusted in various ways depending on the intended application, for example through the choice of type of the particular reinforcing and matrix filaments used, through the proportion of hybrid yarn in the woven or laid precursors, through the proportion of matrix filament in the hybrid yarns used, through the distribution of different yarn types in the woven or laid precursors, and also through the particular production conditions employed.

The gas and/or liquid permeability is controllably reduced by the melting of the matrix filaments.

Such textile sheet materials comprise a structure woven from reinforcing filaments or at least one set of parallel reinforcing filaments and a matrix component composed of thermoplastic polymer.

The matrix component in the textile sheet materials may only account for a small proportion, for example 3% by weight, based on the weight of the textile sheet material; however, the matrix component may also account for a high proportion, for example 70% by weight, preferably 3 to 50% by weight, based on the weight of the textile sheet material.

The matrix component can be uniformly distributed over the textile sheet material or, preferably, be present in a predetermined pattern.

The matrix component can embed the reinforcing filaments (in which case a particularly low gas or liquid permeability is obtained) or else only bind them, depending on the particular amount of matrix component.

The present invention also provides textile sheet materials of predetermined gas and/or liquid permeability, comprising a woven structure formed from reinforcing filaments or comprising at least one set of parallel reinforcing filaments and a matrix component composed of thermoplastic polymer, wherein reinforcing filaments and matrix component consist of the same class of polymer (single-material combinations), preferably of combinations of polyamide/polyamide, polyolefin/polyolefin and especially polyester/polyester.

The gas and/or liquid permeability of the textile sheet materials producible according to the invention can be varied within wide limits.

Preference is given to textile sheet materials having a gas permeability of not more than 80, preferably not more than 30, especially not more than 12 $dm^3$ of air per minute per square decimeter of fabric under a pressure drop of 500 Pa (measured in accordance with DIN 53887).

The gas permeability is measured on the line of DIN 53 887 on a fabric having a measuring area of 100 $cm^2$, using a pressure drop (measuring pressure) of 500 Pa.

Textile sheet materials of the above-defined type which are particularly preferred for use as an air bag are additionally characterized by a Mullen burst strength of not less than 3500 kPa, an ultimate tensile strength of not less than 1300N per 5 cm of fabric width, a tear strength as measured by the limb method of not less than 100N and an ultimate extension of not less than 20%.

The recited properties are determined as follows:

Mullen burst strength: U.S. Federal Test Method Standard No: 191A, Method 5122

High tensile strength: according to DIN 53 857 Part 1

Tear strength (limb method): on the line of DIN 53 356 (sample size 150*200 mm tubed; evaluation according to DIN 53539 B)

Ultimate extension: according to DIN 53 857 Part 1.

Very particular preference is given to textile sheet materials wherein the matrix component is present arranged in a predetermined pattern in different amounts to provide different gas and/or liquid permeabilities in predetermined segments of the textile sheet material.

Particularly preferred textile sheet materials are derived from woven or laid structures consisting of the above-defined hybrid yarns.

The textile sheet materials customarily have basis weights from 50 to 600 $g/m^2$, preferably from 50 to 300 $g/m^2$. The thickness of these sheet materials is customarily less than 1.5 mm, preferably not more than 0.45 mm.

The basis weight of the fabrics of this invention is measured in accordance with DIN 53 854; the thickness of the fabrics of this invention is measured on the line of DIN 53 855 Part 1 (measuring area 10 $cm^2$; measuring pressure 50 $cN/cm^2$).

The textile sheet materials of this invention can be used in a multiplicity of applications, for example as protective clothing, such as bullet-, cut-, puncture- or sawproof garments or weather-protective clothing, or anti-g suits or diver's clothing; as tent fabrics or groundsheets; as linings for vessels, such as silo, pool or container linings, as bagmaker's goods; as materials for manufacturing shoes; as packaging materials, as maritime textiles, such as textiles for fabricating inflatable dinghies, life jackets or inflatable liferafts; as textile building material, such as textiles for manufacturing Zeppelins; as loadbearing material, such as material for manufacturing lightweight conveyor belts; as goetextiles, for use in water engineering, such as rain collection vessels or landfill coverings; as sail or tarpaulin, as filter materials or in particular for manufacturing airbags.

The present invention further provides for the use of the textile sheet materials of this invention for the abovementioned purposes.

The examples which follow illustrate the invention.

EXAMPLE

A Dornier gripper weaving machine was used to plainweave a fabric with 36 threads/cm in the warp and 22 threads/cm in the weft.

The warp consisted of interlaced 315 dtex 100 filament polyethylene terephthalate yarns having 120 turns per cm of twist.

The weft consisted of 420 dtex 72 filament hybrid yarns obtained by commingling a 280 dtex 48 filament polyethylene terephthalate feed yarn and a 140 dtex 24 filament isophthalic acid-modified polyethylene terephthalate feed yarn. The proportion of isophthalic repeat units in the polyester was 33 mol %, based on the total amount of dicarboxylic acid components.

The fabric had a basis weight of 234 $g/m^2$ and the following loomstate properties:

ultimate tensile strength (measured according to din 53 857 part 1):
warpways: 2854.4 (n/5 cm)
weftways: 1932.2 (n/5 cm)

Ultimate extension (measured according to DIN 53 857 part 1):
warpways: 36.6%
weftways: 25.2% width: 172 cm total number of warp ends: 6192

What is claimed is:

1. A woven or laid structure comprising at least two systems of parallel threads, at least one of these thread systems having more than 10 threads per centimeter and comprising at least 10%, based on the thread system, of hybrid yarns comprising reinforcing filaments and lower melting matrix filaments composed of thermoplastic polymers having a melting point which is at least 30° C. below the melting point or the decomposition point of the reinforcing filaments, and wherein the reinforcing filaments have an initial modulus greater than 10 GPa.

2. The woven or laid structure of claim 1 comprising two thread systems having thread counts of at least 15 threads per centimeter and at least 10%, of hybrid yarns comprising reinforcing filaments and lower melting matrix filaments composed of thermoplastic polymers.

3. The woven or laid structure of claim 2 consisting of two thread systems each comprising at least 95% of hybrid yarns comprising reinforcing filaments and lower melting matrix filaments composed of thermoplastic polymers.

4. The woven or laid structure of claim 1, wherein at least one thread system comprises a combination of hybrid yarns comprising reinforcing filaments and lower melting matrix filaments and of yarns composed of loadbearing filaments, or at least one thread system comprises a combination of different hybrid yarns comprising reinforcing filaments and different proportions of lower melting matrix filaments, in each case a plurality of the hybrid yarns and of the yarns composed of loadbearing filaments or a plurality of the different hybrid yarns being arranged in a predetermined pattern.

5. The woven or laid structure of claim 1, wherein the reinforcing filaments are selected from the group consisting of glass, carbon, aromatic polyamide and polyester.

6. The woven or laid structure of claim 1, wherein the matrix filaments consist of polybutylene terephthalate.

7. The woven or laid structure of claim 1, wherein reinforcing filaments and matrix filaments belong to the same class of polymer.

8. The woven or laid structure of claim 7, wherein reinforcing filaments and matrix filaments consist of combinations of polyamide/polyamide, polyolefin/polyolefin and in particular of polyester/polyester.

9. The woven or laid structure of claim 1, wherein the matrix filaments consist of a modified polyethylene terephthalate containing structural repeat units of the formulae I and II $$—O—OC—Ar^1—CO—O—R^1— \quad (I),$$

and $$—O—OC—R^2—CO—O—R^3— \quad (II),$$

where $Ar^1$ is a bivalent mono- or polycyclic aromatic radical whose free valances are disposed para or comparably parallel or coaxial to each other, $R^1$ and $R^3$ are independently of each other bivalent aliphatic or cycloaliphatic radicals, and $R^2$ is a bivalent aliphatic, cycloaliphatic or mono- or polycyclic aromatic radical whose free valences are disposed meta or comparably angled to each other.

10. The woven or laid structure of claim 9, wherein the matrix filaments consist of a modified polyethylene terephthalate containing 40 to 95 mol % of structural repeat units of the formula I and 60 to 5 mol % of structural repeat units of the formula II where $Ar^1$ is 1,4-phenylene and/or 2,6-naphthylene, $R^1$ and $R^3$ are each ethylene and $R^2$ is 1,3-phenylene.

11. The woven or laid structure of claim 1, wherein the matrix filaments consist of a thermoplastic and elastomeric polymer.

12. The woven or laid structure of claim 11, wherein the thermoplastic and elastomeric polymer is a polyester containing structural repeat units of the formulae III and IV $$—O—OC—Ar^2—CO—O—R^4— \quad (III),$$

and $$—O—OC—Ar^3—CO—O—R^5— \quad (IV),$$

where $Ar^2$ and $Ar^3$ are independently of each other bivalent aromatic radicals, $R^4$ is a bivalent aliphatic or cycloaliphatic radical, and $R^5$ is the bivalent radical of a polyalkylene ether, of the formula V $$—[C_oH_{2o}—O]_z—C_oH_{2o}— \quad (V),$$

where o is an integer from two to four, and z is an integer from 1 to 50.

13. The woven or laid structure of claim 12, wherein $Ar^2$ and $Ar^3$ are each 1,4-phenylene, $R^4$ is ethylene, o is four and the proportion of structural repeat units of the formula V is 5 to 60% by weight, based on the proportion of the polyester molecule.

14. The woven or laid structure of claim 11, wherein the thermoplastic and elastomeric polymer is a polyurethane containing structural repeat units of the formulae VI and VII $$—[O—OC—NH—R^6—NH—CO—O—R^7]— \quad (VI),$$

$$—[O—OC—NH—R^8—NH—CO—O—R^9]— \quad (VII),$$

where $R^6$, $R^7$ and $R^8$ are each independently of the others a bivalent aliphatic, cycloaliphatic, aromatic or araliphatic radical, $R^6$ and $R^8$ are bivalent mono- or bicyclic aromatic radicals, $R^7$ is a radical of the formula $—C_pH_{2p}—$, where p is an integer between 2 and 6, or a radical derived from cyclohexanedimethanol, $R^9$ is a radical of the formulae VIII and/or IX $$—[C_qH_{2q}—O]_x—C_qH_{2q}— \quad (VIII),$$

$$—[R^{10}—O—OC—R^{11}—CO—O]_y—R^{10}— \quad (IX),$$

where q is an integer from two to four and x is an integer from 1 to 50, $R^{10}$ is a bivalent aliphatic or cycloaliphatic radical or a radical of the formula VIII, $R^{11}$ is a bivalent aliphatic, cycloaliphatic, aromatic or araliphatic radical, and y is an integer from 1 to 50.

15. The woven or laid structure of claim 14, wherein $R^7$ is 1,4-butanediyl, $R^9$ is a radical of the formula VIII where q is an integer from two to four, and x is an integer from 1 to 50, and $R^6$ and $R^8$ are independently of each other phenylene or naphthylene.

16. A process for producing textile sheet materials of predetermined gas permeability, which comprises a) providing a woven or laid structure comprising hybrid yarns as claimed in claim 1, and b) subjecting this woven or laid structure to a thermal treatment under such conditions that the matrix filaments melt to form a textile sheet material of predetermined gas permeability.

17. The process of claim 16, wherein the woven or laid structures provided in step a) comprise hybrid yarns arranged in a predetermined pattern, wherein at least one thread system comprises a combination of hybrid yarns comprising reinforcing filaments and lower melting matrix filaments and of yarns composed of loadbearing filaments, or at least one thread system comprises a combination of different hybrid yarns comprising reinforcing filaments and different proportions of lower melting matrix filaments, in each case a plurality of the hybrid yarns and of the yarns composed of loadbearing filaments or a plurality of the different hybrid yarns.

18. A textile sheet material of predetermined gas and/or liquid permeability, comprising a woven structure formed from reinforcing filaments and a matrix component composed of thermoplastic polymer or comprising at least one set of parallel reinforcing filaments and a matrix component composed of thermoplastic polymer, wherein reinforcing filaments and matrix component consist of the same class of polymer.

19. The textile sheet material of claim 18, characterized by a gas permeability of not more than 80, $dm^3$ of air per minute per square decimeter of fabric under a pressure drop of 500 Pa (measured in accordance with DIN 53887).

20. The textile sheet material of claim 18, characterized by a Mullen burst strength of not less than 3500 kPa, an ultimate tensile strength of not less than 1300N per 5 cm of fabric width, a tear strength as measured by the limb method of not less than 100N and an ultimate extension of not less than 20%.

21. The textile sheet material of claim 18, wherein the matrix component is present arranged in a predetermined pattern in different amounts to provide different gas and/or liquid permeabilities in predetermined segments of the textile sheet material.

22. The textile sheet material of claim 18, wherein the reinforcing filaments have an initial modulus greater than 10 GPa and consist of polyester, and the matrix component consists of polybutylene terephthalate.

23. The textile sheet material of claim 18, wherein the reinforcing filaments have an initial modulus greater than 10 GPa and consist of polyester, and the matrix component consists of modified polyethylene terephthalate containing structural repeat units of the formulae I and II $$—O—OC—Ar^1—CO—O—R^1 \quad (I),$$

and $$—O—OC—R^2—CO—O—R^3 \quad (II),$$

where $Ar^1$ is a bilvalent mono- or polycyclic aromatic radical whose free valances are disposed para or comparably parallel or coaxial to each other, $R^1$ and $R^3$ are independently of each other bivalent aliphatic or cycloaliphatic radicals, and $R^2$ is a bivalent aliphatic, cycloaliphatic or mono- or polycyclic aromatic radical whose free valences are disposed meta or comparably angled to each other.

24. The textile sheet material of claim 23, wherein the matrix component consists of a modified polyethylene terephthalate containing 40 to 95 mol % of structural repeat units of the formula I and 60 to 5 mol % of structural repeat units of the formula II where $Ar^1$ is 1,4-phenylene and/or 2,6-naphthylene, $R^1$ and $R^3$ are each ethylene and $R^2$ is 1,3-phenylene.

25. The textile sheet material of claim 18, wherein the reinforcing filaments have an initial modulus greater than 10 GPa and consist of polyester, and the matrix component consists of a thermoplastic and elastomeric polyester.

26. The textile sheet material of claim 25, wherein the thermoplastic and elastomeric polyester contains structural repeat units of the formulae III and IV $$—O—OC—Ar^2—CO—O—R^4 \quad (III),$$

and $$—O—OC—Ar^3—CO—O—R^5 \quad (IV),$$

where $Ar^2$ and $Ar^3$ are independently of each other bivalent aromatic radicals, $R^4$ is a bivalent aliphatic or cycloaliphatic radical, and $R^5$ is the bivalent radical or a polyalkylene ether of the formula V $$—[C_oH_{2o}—O]_z—C_oH_{2o}— \quad (V),$$

where o is an integer from two to four, and z is an integer from 1 to 50.

27. The textile sheet material of claim 26, wherein $Ar^2$ and $Ar^3$ are each 1,4-phenylene, $R^4$ is ethylene, $R^5$ is a radical of the formula V $$—[C_oH_{2o}—O]_z—C_oH_{2o}— \quad (V),$$

where o is four and z is an integer from 10 to 18, and the proportion of structural repeat units of the formula V is 5 to 60% by weight, based on the proportion of the polyester molecule.

28. A method of rising the textile sheet materials of claim 18 as protective clothing, as tent fabrics or groundsheets; as linings for vessels, as bagmaker's goods, as materials for manufacturing shoes; as packaging materials; as maritime textiles, as textile building material, as loadbearing material, as geotextiles; for use in water engineering, as sail or tarpaulin, as filter materials or for manufacturing airbags.

29. The method of claim 28, wherein the maritime textiles are textiles for manufacturing inflatable dinghies, life jackets or inflatable life-rafts.

30. The method of claim 28, wherein the linings for vessels are silo, pool or container linings.

31. The method of claim 28, wherein the textile sheet materials are used for manufacturing airbags.

* * * * *

UNITED STATES PATENT AND TRADEMARK OFFICE

CERTIFICATE OF CORRECTION

PATENT NO. : 5,863,644
DATED : JANUARY 26, 1999
INVENTOR(S) : BURKHARD BÖNIGK

It is certified that error appears in the above-identified patent and that said Letters Patent is hereby corrected as shown below:

COVER PAGE, in the title, before "PERMEABILITY" insert -- LIQUID --.

Column 1, line 1, in the title, before "PERMEABILITY" INSERT -- LIQUID --.

Column 7, line 41, "465-461" should read -- 456-461 --.

Column 16, line 32 (claim 28, line 1), "rising" should read -- using --.

Signed and Sealed this

Twenty-fifth Day of May, 1999

*Attest:*

Q. TODD DICKINSON

*Attesting Officer*

*Acting Commissioner of Patents and Trademarks*